United States Patent [19]

LaBaire

[11] 4,354,801

[45] Oct. 19, 1982

[54] REACTION FAN WITH NOISE SUPPRESSION

[75] Inventor: William P. LaBaire, Spencer, Mass.

[73] Assignee: Coppus Engineerng Corporation, Worcester, Mass.

[21] Appl. No.: 227,623

[22] Filed: Jan. 23, 1981

[51] Int. Cl.[3] ..... F01D 1/20

[52] U.S. Cl. ..... 415/80; 415/119; 416/171

[58] Field of Search ..... 415/80, 81, 82, 119, 415/142; 416/171; 60/39.34, 39.35

[56] References Cited

U.S. PATENT DOCUMENTS

| | | | |
|---|---|---|---|
| 1,152,045 | 8/1915 | Reeves | 60/39.34 |
| 1,880,747 | 10/1932 | Bowen | 415/80 X |
| 3,104,803 | 9/1963 | Flatt | 415/80 X |
| 3,237,849 | 3/1966 | Krell | 415/119 X |

FOREIGN PATENT DOCUMENTS

| | | | |
|---|---|---|---|
| 1600841 | 9/1970 | France | 415/119 |
| 1437510 | 5/1976 | United Kingdom | 415/119 |

*Primary Examiner*—Philip R. Coe

*Attorney, Agent, or Firm*—Thompson, Birch, Samuels & Gauthier

[57] ABSTRACT

A reaction-type fan has a housing with a central collar rotatably supporting a hub having blades extending radially therefrom. Nozzles are carried at the tip portions of the blades. Compressed air is directed through the housing, collar, hub and blades to the nozzles. The nozzles are arranged such that the reactive force of the compressed air exiting therefrom rotates the blades, thereby causing ambient gases to be drawn through the housing. Sound absorbing elements are positioned along the flow path of the compressed air to attenuate noise associated therewith.

9 Claims, 6 Drawing Figures

REACTION FAN WITH NOISE SUPPRESSION

BACKGROUND OF THE INVENTION

1. Field of the Invention

This invention relates generally to reaction-type fans, and in particular to those reaction-type fans which are driven by fluid under pressure, for example compressed air.

2. Description of the Prior Art

Compressed air reaction-type fans are employed in industrial and marine applications to supply clean air to or to exhaust air contaminated by fumes, particulates, etc. from, various enclosures. Although such fans have been developed to the point where they are capable of achieiving extremely efficient high volume operation, this advantage has been offset to some extent by an accompanying relatively high noise level generated by the high velocity flow of compressed air used to drive the fan blades.

SUMMARY OF THE INVENTION

The present invention has as its primary objective the provision of a compressed air reaction-type fan incorporating improved means for attenuating noise associated with the driving flow of compressed air.

Another object of the present invention is to provide a noise attenuating means for compressed air reaction type fans which does not significantly increase the design complexity or cost of such fans.

In keeping with these objectives and others which will become apparent hereinafter, one feature of the present invention is to provide the blade-mounted compressed air nozzles with sound attenuating sleeves made from a suitable resilient sound absorbing material, preferably a woven metallic mesh. Preferably, this feature is combined with the arrangement of the fan blade tips and the compressed air nozzles carried thereon in a circular groove in the surrounding housing wall, with the groove also being lined with resilient sound attenuating material, again preferably a woven metallic mesh.

As a further feature of the present invention, a baffle member is positioned in the compressed air conduit leading to the blade-mounted nozzles so as to disrupt any tendency of the compressed air to assume a noisy circular or swirling flow.

The foregoing features each contribute significantly to the attenuation of noise, and their use in combination produces a net attenuation which markedly reduces the overall noise level of the fan without materially increasing its cost.

The novel features which are considered as characteristic of the present invention are set forth in particular in the appended claims. The invention itself, however, both as to its construction and operation, together with additional objects and advantages thereof, will best be understood from the following description of a preferred embodiment when read in connection with the accompanying drawings.

DESCRIPTION OF PREFERRED EMBODIMENT

Figure 1:
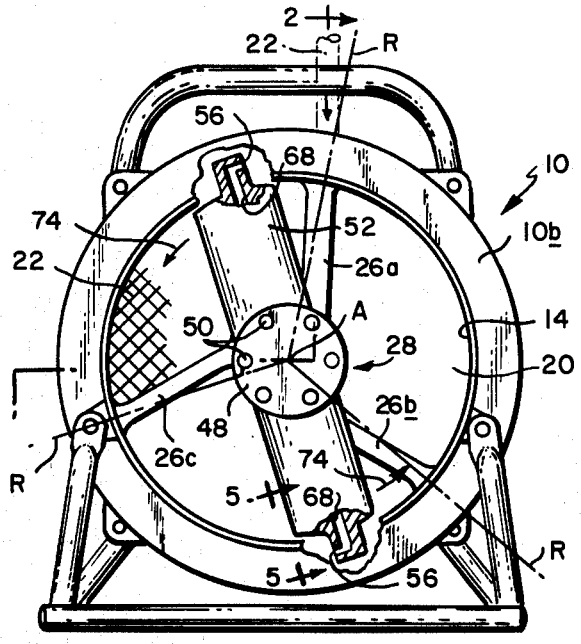
FIG. 1 is a front elevational view of a compressed air reaction-type fan in accordance with the present invention, with portions of the housing broken away.

Referring now to the drawings, a fan in accordance with the present invention is shown comprising a generally cylindrical housing 10 consisting of housing sections 10*a* and 10*b* joined together along a common interface 10*c* by means of bolts indicated typically at 12. The housing sections 10*a*, 10*b* collectively define an interior wall 14 surrounding a fan chamber 16. Inlet and outlet openings 18 and 20 communicate with the fan chamber 16. Both openings 18, 20 are preferably covered by safety screens 22.

A generally cylindrical collar 24 is fixed at a central location within the fan chamber 16 by support struts 26*a*, 26*b* and 26*c* which extend inwardly from the interior housing wall 14. The interior housing wall 14 as well as the collar 24 and the inlet and outlet openings 18, 20 have a common central axis indicated at "A" in FIGS. 1 and 2.

A rotor assembly indicated generally at 28 is supported by the collar 24 for rotation about the axis A. As can be best seen in FIG. 2, the rotor assembly includes a cylindrical shaft 30 located in a second chamber 32 in the collar 24. The shaft 30 is journalled for rotation between roller bearing assemblies 34*a*, 34*b*. The hub 36 of the rotor 28 is keyed to the shaft 30 at 38 and is axially held in position thereon by any convenient means such as for example the lock nut 40 threaded onto the shaft end. A lockwasher 42 is preferably interposed between the lock nut 40 and the hub 36.

One end of the chamber 32 is closed by a housing cap 44 detachably secured to the collar 24 by bolts 46. The opposite end of the chamber 32 is closed by the rotor hub 36 and fan cap 48 detachably secured to the hub 36 by bolts 50. The rotor assembly 28 further includes at least two fan blades 52 which extend radially away from the axis A towards the inner housing wall 14. The fan blades have tips 52*a* which protrude into a continuous groove 54 in the interior housing wall 14. Each blade tip 52*a* carries a compressed air nozzle 56. The nozzles 56 are connected to an external compressed air fitting 58 in housing section 10*a* by a conduit means which includes: a passageway 60 leading through support strut 26*a* from fitting 58 to a circular space 62 at one end of the interior chamber 32 in collar 24; a cylindrical passageway 64 extending through the shaft 30; the hollow interior 66 of hub 36; and passageways 68 leading from the hub interior to the nozzles, with the ends of the passageways 68 at the blade tips 52*a* being plugged as at 70. A ring seal 71 is interposed between the collar interior and the shaft 30.

With this arrangement, compressed air can be fed to the fan via an auxiliary line 72 detachably connected tothe fitting 58. The compressed air will be conducted by the above-described conduit means to the nozzles 56. The reactive force of the compressed air exiting from the nozzles will cause the rotor 28 to be rotatably driven in the direction indicated diagrammatically by the arrows 74 in FIG. 1. As a result of this rotative movement, typically at speeds in the range of 6000 R.P.M., ambient gases will be drawn by the fan blades 52 through the housing chamber 16 via inlet and outlet openings 18, 20.

In order to attenuate the noise normally associated with a high velocity flow of compressed air being directed to and through the blade-mounted nozzles 56, cylindrical sleeves 76 of resilient sound absorbing material are inserted in the nozzles. The sleeves 76 surround the exiting flow of compressed air through the nozzles, and absorb energy that might otherwise contribute to the production of noise. Preferably, the sound absorbing material will consist of a woven metallic mesh, for example.

In addition to the sound absorbing sleeves 76 in the nozzles 56, the present invention also includes a lining 78 of resilient sound absorbing material for the continuous groove 54. Here again, the lining material may consist of a woven metallic mesh. The sound absorbing lining 78 further reduces the noise level of the compressed air exiting from the nozzles 56.

Figure 3:
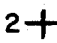
FIG. 3 is an enlarged view of the center inlet side of the fan, with portions of the housing cap broken away.
Figure 3:
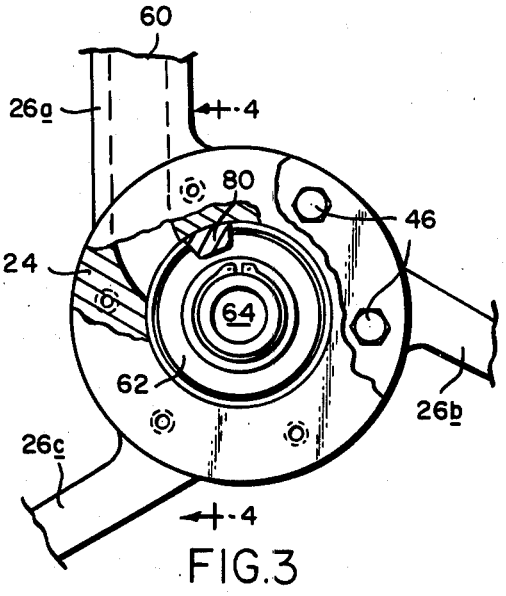
Figure 6:
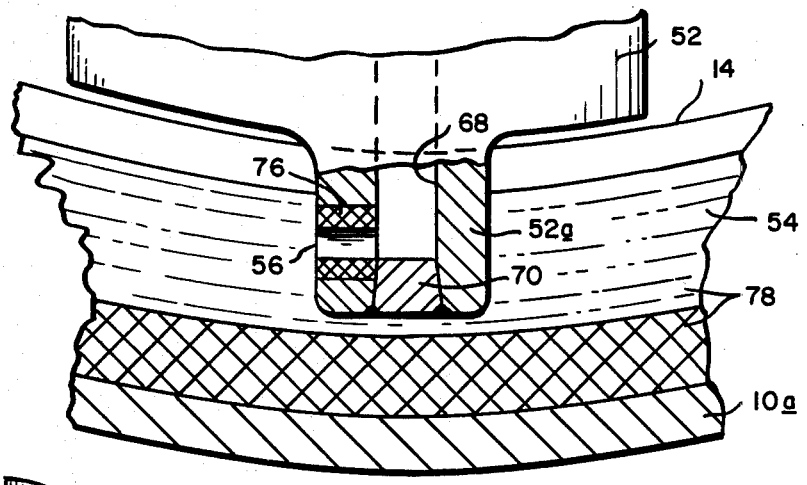
FIG. 6 is a sectional view taken along line 6—6 of FIG. 5.
Figure 5:
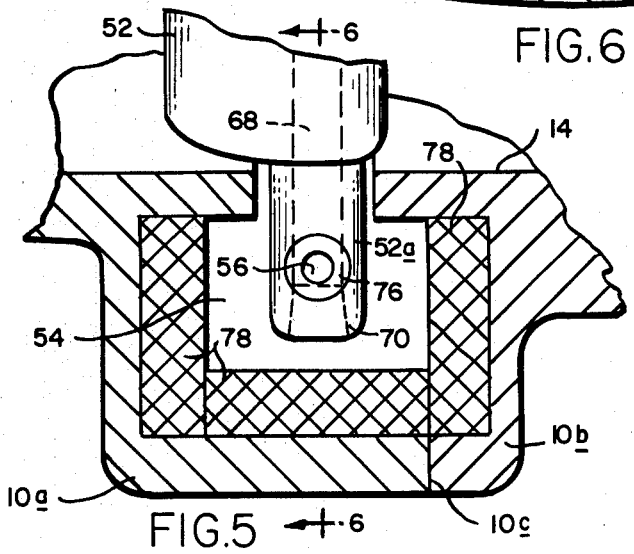
FIG. 5 is an enlarged sectional view taken along line 5—5 of FIG. 1.
Figure 2:
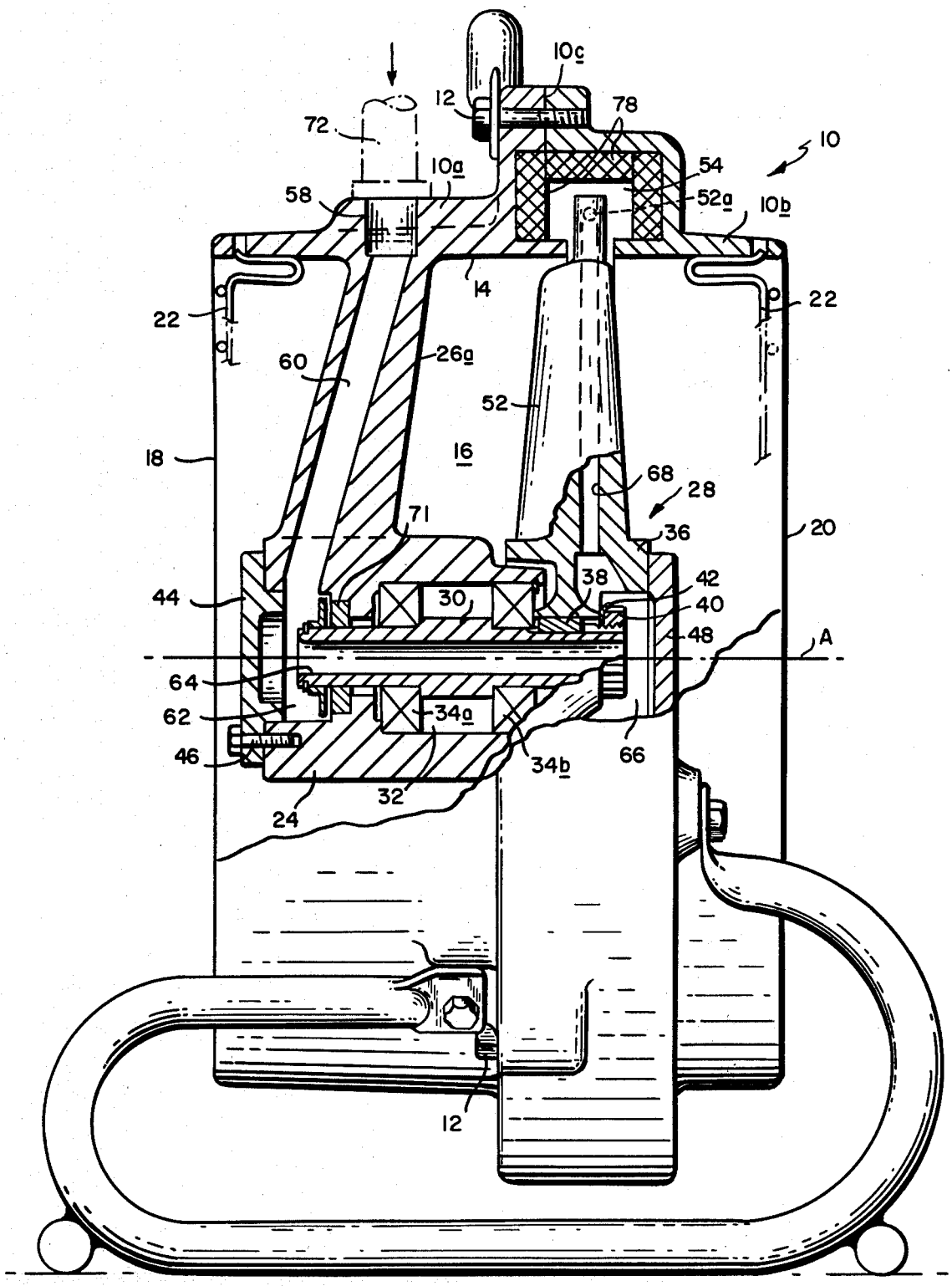
FIG. 2 is a sectional view on an enlarged scale taken along line 2—2 of FIG. 1.

It will additionally be seen from FIGS. 1 and 3 that the support struts 26 are each skewed slightly from a reference radius "R" extending from wall 14 to axis A. Skewing of the struts results in a "scissor-like" effect as the fan blades 52 rotate past each strut. This produces a quieter operation than might otherwise result if the struts were radially arranged and the fan blades rotated past each strut in a sudden fashion.

Figure 4:
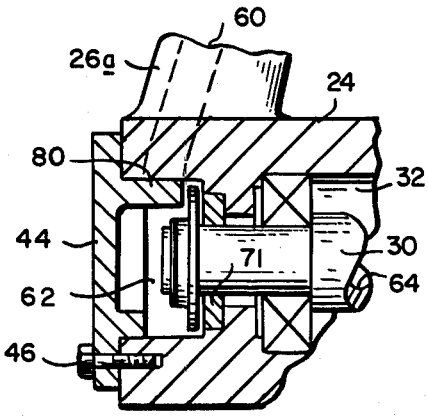
FIG. 4 is a sectional view taken along line 4;13 4 of FIG. 3.

However, because the strut 26*a* is skewed, the flow of compressed air entering space 62 via passageway 60 exhibits a tendency to assume a circular flow. If left undisturbed, this circular flow will produce a high-pitched noise. To eliminate this problem, and as shown in FIGS. 3 and 4, the present invention further includes the provision of a baffle member 80 protruding from the housing cap 44 inwardly into the space 62. The baffle member disrupts any tendency of the compressed air to assume a circular flow, and thereby markedly attenuates any accompanying noise.

While the nozzle sleeves 76, the groove liner 78 and the baffle member 80 individually provide significant noise abatement, their combined effect when employed as herein disclosed is particularly advantageous in that reductions in noise level of approximately 18% can be achieved.

I claim:

1. A reaction-type fan comprising in combination:

a housing structure having a circular interior wall defining a chamber, with opposed inlet and outlet openings communicating with said chamber, and with a collar positioned at a fixed central location within said chamber by support struts extending inwardly from said interior wall, said interior wall as well as said collar and said inlet and outlet openings having a common central axis;

a rotor assembly supported by said collar for rotation about said axis, said rotor assembly having blades extending radially outwardly from said axis towards said interior wall;

nozzles carried at the tip portions of said blades;

conduit means for directing a flow of a pressurized gaseous medium from the exterior of said housing to said nozzles, the arrangement of said nozzles being such that the reactive force of the pressurized gaseous medium exiting therefrom causes said rotor to rotate about said axis, the said rotation in turn causing ambient gases to be drawn through said housing via said inlet and outlet openings; and sound attenuating means for lessening the level of sound associated with the flow of said pressurized gaseous medium through said conduit means and said nozzles, said sound attenuating means including cylindrical sleeves of resilient sound absorbing material surrounding the flow path of said pressurized gaseous medium through said nozzles.

2. The fan of claim 1 wherein said circular interior wall has a continuous groove into which protrudes the blade tip portions carrying said nozzles, said groove being lined with sound absorbing material.

3. The fan of claims 1 or 2 wherein said sound absorbing material consists of a woven metallic mesh.

4. The fan of claim 1 wherein each said support struts is skewed from a reference radius extending from said interior wall to said axis, and wherein said conduit means includes a first passageway leading through one of said struts to a circular space within said collar, a second passageway extending axially through said rotor and in communication at opposite ends with said circular space and third passageways extending through said blades to said nozzles.

5. The fan of claim 4 wherein said sound attenuating means further includes a baffle member protruding into said circular space to disrupt any tendency of said pressurized gaseous medium to assume a circular flow about said axis within said space.

6. The fan of claim 5 wherein said circular space is closed at one end by a cap secured to said collar, and wherein said baffle member consists of a protrusion on said cap.

7. A reaction-type fan comprising in combination:

a housing structure having a circular interior wall surrounding a chamber, with opposed inlet and outlet openings communicating with said chamber, and with a cylindrical collar positioned at a fixed central location within said chamber by support struts extending inwardly from said interior wall, said interior wall as well as said collar and said inlet and outlet openings having a common central axis;

a rotor assembly supported by said collar for rotation about said axis, said rotor assembly having blades extending radially outwardly from said axis towards said interior wall;

nozzles carried at the tip portions of said blades;

conduit means for directing a flow of a pressurized gaseous medium from the exterior of said housing to said nozzles, the arrangement of said nozzles being such that the reactive force of the pressurized gaseous medium exiting therefrom causes said rotor to rotate about said axis, the said rotation in turn causing ambient gases to be drawn through said housing via said inlet and outlet openings; and sound attenuating means for lessening the level of sound associated with said flow of pressurized gaseous medium, said sound attenuating means including a continuous groove in said interior wall into which protrude the blade tip portions carrying said nozzles, said groove being lined with a resilient sound absorbing material.

8. The fan of claim 7 wherein said sound absorbing material consists of a woven metallic mesh.

9. A reaction-type fan comprising in combination:

a housing structure having a circular interior wall defining a chamber, with opposed inlet and outlet openings communicating with said chamber, and with a collar positioned at a fixed central location within said chamber by support struts extending inwardly from said interior wall, said interior wall as well as said hub and said inlet and outlet openings having a common central axis, with each of said support struts being skewed from a reference radius extending from said interior wall to said axis;

a rotor assembly supported by said collar for rotation about said axis, said rotor assembly having blades extending radially outwardly from said axis towards said interior wall;

nozzles carried by the tip portions of said blades;

conduit means for directing a flow of pressurized gaseous medium from the exterior of said housing to said nozzles, said conduit means including a first passageway leading through one of said struts to a circular space within said collar, with a second passageway extending axially through said rotor and in communication at opposite ends with said circular space and third passageways leading through said blades to said nozzles, the arrangement of said nozzles being such that the reactive force of the pressurized gaseous medium exiting therefrom causes said rotor to rotate about said axis, the said rotation in turn causing ambient gases to be drawn through said housing via said inlet and outlet openings; and sound attenuating means for lessening the level of sound associated with the flow of said pressurized gaseous medium through said conduit means, said sound attenuating means including a baffle member protruding into said circular space to disrupt any tendency of said pressurized gaseous medium to assume a circular flow about said axis within said circular space.

* * * * *